US005775159A

United States Patent [19]

Schröter et al.

[11] Patent Number: 5,775,159

[45] Date of Patent: Jul. 7, 1998

[54] METHOD OF MANUFACTURING AN UNDERCUT DEEP-DRAWN WORKPIECE

[75] Inventors: Reinhard Schröter, Solingen; Peter Bach, Wermelskirchen, both of Germany

[73] Assignee: Ed. Scharwachter GmbH & Co. KG, Remscheid, Germany

[21] Appl. No.: 651,380

[22] Filed: May 22, 1996

[30] Foreign Application Priority Data

Jun. 6, 1995 [DE] Germany ..... 195 20 554.5

[51] Int. Cl.[6] ..... B21D 22/00; B21D 22/21; B21C 37/02

[52] U.S. Cl. ..... 72/348; 72/379.2

[58] Field of Search ..... 72/347, 348, 356, 72/379.2, 379.4, 349

[56] References Cited

U.S. PATENT DOCUMENTS

| | | | |
|---|---|---|---|
| 1,389,739 | 9/1921 | Carlson | 72/348 |
| 1,891,316 | 12/1932 | Nyberg | 72/348 |
| 4,423,616 | 1/1984 | Pease | 72/348 |
| 4,453,395 | 6/1984 | Takeda et al. | 72/348 |

*Primary Examiner*—Lowell A. Larson
*Assistant Examiner*—Rodney Butler
*Attorney, Agent, or Firm*—Anderson, Kill & Olick, P.C.

[57] ABSTRACT

A method of manufacturing of an undercut deep-drawn workpiece from a sheet material including deforming a sheet material into a pot-shaped piece having a circular cross-section with a diameter, which decreases in a course of deformation, while retaining a flat circumferential rim flange, increasing a depth of the pot-shaped piece with formation of an outwardly cambered bottom substantially simultaneously with decreasing the diameter of the pot-shaped piece, forming, one after another, two opposite flat surface side walls on the pot-shaped piece, with bringing them into divergent, relative to each other, angular positions, while synchronously flattening the bottom of the pot-shaped piece, and forming two further opposite parallel flat surface side walls to obtain a substantially rectangular cross-section of the pot-shaped piece.

4 Claims, 4 Drawing Sheets

METHOD OF MANUFACTURING AN UNDERCUT DEEP-DRAWN WORKPIECE

BACKGROUND OF THE INVENTION

The present invention relates to a method of manufacturing of undercut deep-drawn workpieces and, in particular, to a method of manufacturing deep-drawn workpieces from a sheet material, which are closed from five sides and have at least two non-parallel walls and which are used primarily as hinge or door supports and are mounted in wall regions or girder of a motor vehicle body.

To provide for attachment of door or hood hinges to parts, in particular, to support parts of a vehicle body, it is conventional to form a hinge part or a stay bar connection of the vehicle door stop as a separate hinge half which is secured to an appropriate support part of a vehicle body. This requires attachment of the hinge half either by welding or by screws.

Because of the particular type of their attachment to support parts of a motor vehicle body, the known conventional hinges or door stay bar connections are characterized by their particular arrangement on the support parts of the vehicle body at which the hinge axis is located inwardly of the part. However, in view, on one hand, of an unchangeable predetermined contour of the vehicle body and, on the other hand, of a likewise constructionally predetermined necessary width of the door on hood opening, such positioning of the hinge axis relative to the support part of the vehicle body in many cases cannot be realized. Therefore, it has been suggested to form the hinge half, which is associated with the vehicle body, as a bracket extending into the support part of the vehicle body, with the bracket being produced by a conventional method. This bracket had a hat-shaped profile and is secured to the wall of the support part of the vehicle body with its rim portion. Such a bracket is disclosed in German Publication DE-05 43 04 922. With such bracket, it is possible to insure inward arrangement of the hinge axis relative to the support part of the vehicle body. However, the drawback of such hinge half consists in that it does not have a substantially closed shape so that the closed shape of the support part is broken. This results in penetration of moisture into the inner space of the support part of the vehicle body and leads to corrosion of the support part. Furthermore, the arrangement of the hinge axis inwardly of the support part of the vehicle body with the above-described means requires an especially stable formation of the bracket thereby a highly undesirable increase in weight and resulting therefrom increase in manufacturing costs. In a particular unfavorable case, when such a bracket is used, additionally, mounting of a hinge reinforcing plate on the support part of the vehicle body becomes necessary. This is because the stop, which limits the pivotal movement of the other hinge half, associated with a door or the hood, should be provided at a certain distance from the wall plane of the support part of the vehicle body. Generally, it is possible and is, per se, known to use, instead of the above-described bracket, a closed pot-shaped hinge half for positioning of a hinge axis inwardly of the support part. Such pot-shaped hinge half is conventionally produced as a shaped piece either as a casting or as a forged piece, which in addition to its relatively large weight, leads to increased costs of mounting of the hinge.

Accordingly, an object of the invention is a method of manufacturing of a door or hood hinge half, which is associated with the vehicle body, provides for a sink-in position of the hinge axis relative to the circumferential wall of a respective support part of the vehicle body, which a relatively small weight, and which can be comparatively easily mounted on the respective support part.

Another object of the invention is a method of manufacturing of the above-described hinge half which will be water-proof and be closed from five sides.

Yet another object of the invention is a method of manufacturing of the above-described hinge half as a deepdrawn piece from a metal sheet material.

A further object of the invention is a method of manufacturing of the above described hinge half having through-openings enabling an offset positioning of the other hinge half associated with the hood or the door.

SUMMARY OF THE INVENTION

These and other objects of the invention, which will become apparent hereinafter, are achieved by providing a method including the steps of deforming a sheet material in at least one stage into a pot-shaped piece having a circular cross-section with a diameter, which decreases in a course of deformation, while retaining a flat circumferential rim flange, increasing a depth of the pot-shaped piece with formation of an outwardly cambered bottom substantially simultaneously with decreasing the diameter of the pot-shaped piece, while retaining a circular cross-section of the potshaped piece, forming, one after another, two opposite flat surface side walls on the pot-shaped piece;

bringing the two opposite side walls into divergent, relative to each other, angular positions, with synchronously flattening the bottom of the pot-shaped piece, and finally, forming two further opposite flat surface side walls to obtain a substantially rectangular cross-section of the pot-shaped piece. the method according to the present invention provides for cost-effective manufacturing of a one-piece hinge half from a sheet material and which can be attached to a support part of the vehicle body in a waterproof manner so that the penetration of moisture into the support part is reliably prevented, while providing for positioning of the hinge axis inwardly of the support part. Further, the method according to the present invention provides for manufacturing of a hinge half which insures positioning of the hinge axis such that it is offset relative to the gudgeon openings for the other hinge half associated with a door or a hood. This insures a maximum possible pivotal angle of the door or the hood.

The method according to the present invention permits to obtain, in a pot-shaped piece closed from all sides, divergent, relative to each other, angular positions of the opposite side walls of the hinge half by simultaneous synchronous deformation of both the bottom region and side wall regions, which provides for an undercut cross-sectional shape of the hinge half, without any fissures and folds.

Another advantage of the method according to the present invention consists in that it is conducted with a high speed.

According to one embodiment the method of the present invention, the pot-shaped piece is initially produced with an outwardly cambered bottom which is flattened simultaneously with bringing the two opposite side walls into divergent, relative to each other, angular position.

Further, according to another embodiment the inventive method, initially, the pot-shaped piece is formed with relatively large arcuate transition regions between the bottom and a pair of opposite side walls, with the radius of one or both arcuate transition regions being reduced simultaneously with bringing the opposite side walls into their divergent angular positions.

Generally, which of the two embodiments of the inventive method is selected depends on the properties of the particular material selected for the manufacturing of the hinge half.

According to a further development of the method according to the present invention, one or both of the side walls can be deformed in a direction transverse to the hinge axis to provide embossing.

According to the inventive method, the gudgeon openings are formed in the two parallel wall located opposite each other.

For effecting the method according to the present invention, there is provided a die having a female die part and an expanding, at least in one direction, a male die part. At that, during the manufacturing of the hinge halves, associated with the vehicle bodies, the movement of the female die part is controlled dependent on a magnitude of an expanding movement of the male die part. This insures a uniform and fold-free formation of the side walls upon withdrawal of the male die part from the pot-shaped piece.

BRIEF DESCRIPTION OF THE DRAWING

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENT

Figure 1A:
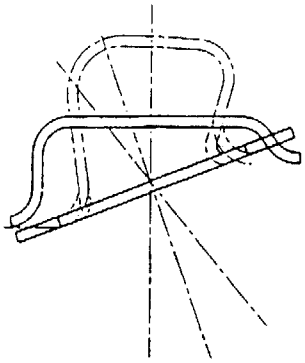
FIGS. 1*a*–1*d* show schematically stages of obtaining a pot-shaped workpiece from a flat sheet material in a first step of a method according to the present invention.
Figure 1B:
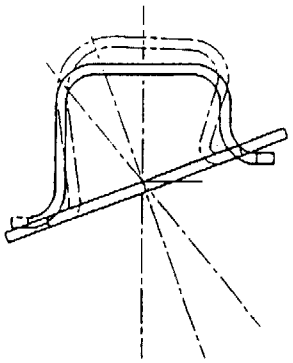
Figure 1C:
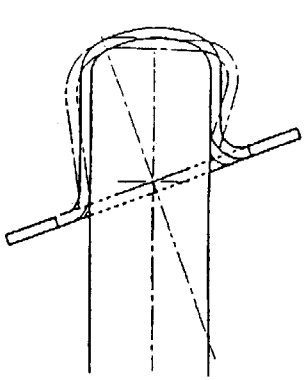
Figure 1D:
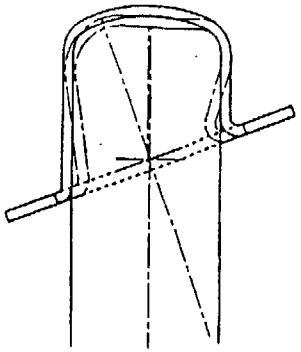
Figure 1A:
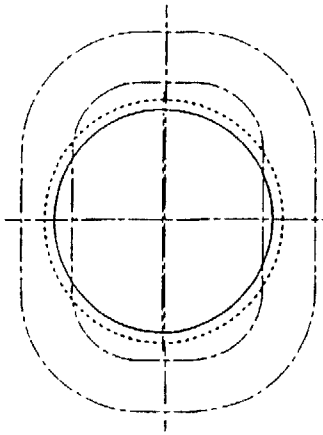
Figure 1B:
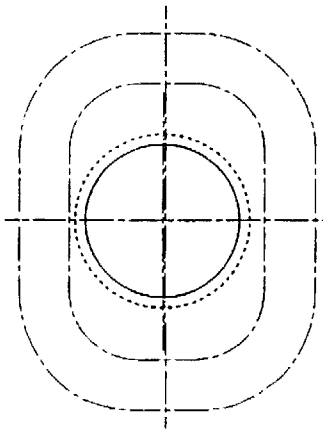
Figure 1C:
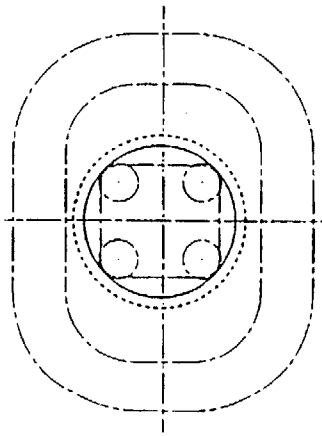
Figure 1D:
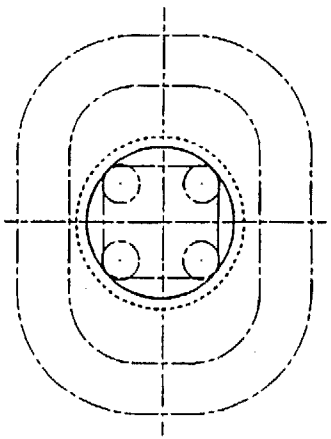
Figure 2A:
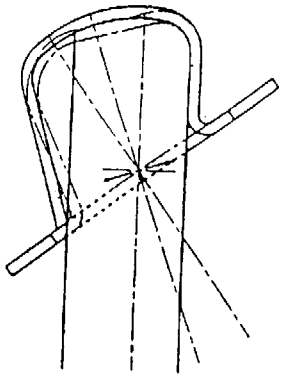
FIG. 2 shows schematically the formation of a first flat surface wall on the pot-shaped workpiece in a second step of a method according to the present invention.
Figure 2:
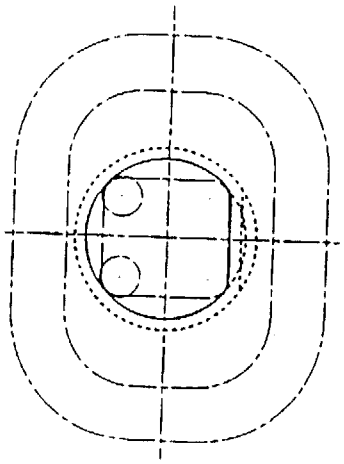
Figure 3:
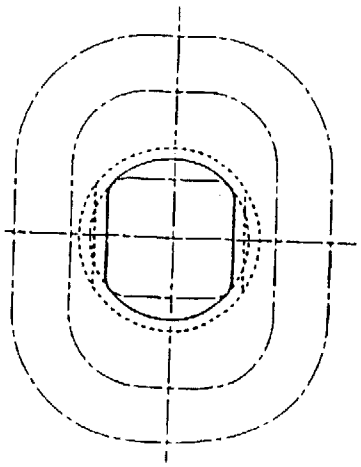
Figure 3A:
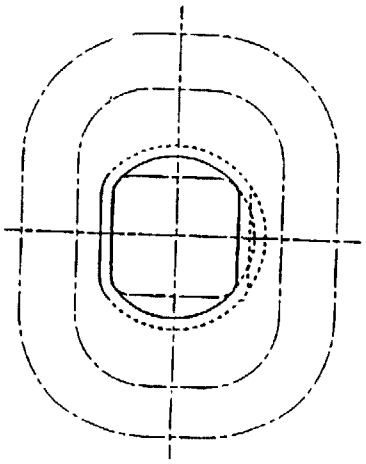

As shown in FIGS. 1*a*–1*d* , a flat sheet material is deformed, in stages a, b, c, and d of a first step of the method according to the present invention, as shown in plan views in FIGS. 1*a*–1*d* , into a somewhat rectangular sheet material pot-shaped piece provided with a circumferential rim flange. The pot-shaped piece is drawn with a circular crosssection and, starting from a first relatively large diameter (FIG. 1*a*) in comparison with the final cross-section shown in the drawing, has its diameter gradually reduced, with the deepening of the pot-shape (FIGS. 1*b*–1*d* ). The pot-shaped piece, which is drawn in the first step, is characterized by an outwardly cambered bottom. In a second step of the method according to the present invention, shown in FIG. 2, a flat surface side wall is formed on the pot-shaped piece having a circular cross-section. At that, the retention of the circular cross-section of the remaining circumferential region of the pot-shaped piece results in an inclination of the formed flat side wall toward the rim flange plane.

Figure 3:
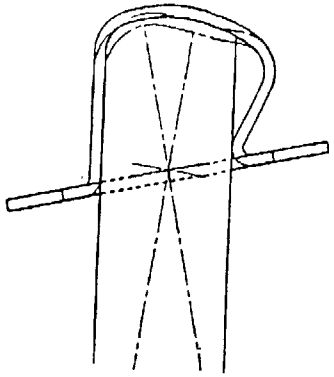
FIGS. 3 and 3*a* show schematically the formation of a second flat surface wall on the pot-shaped workpiece in a third step of the method according to the present invention.
Figure 3A:
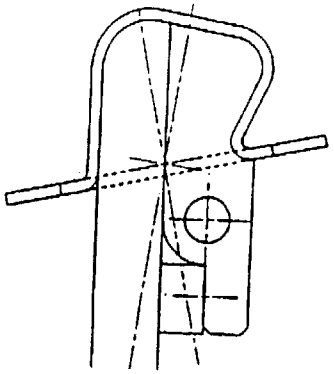
Figure 4A:
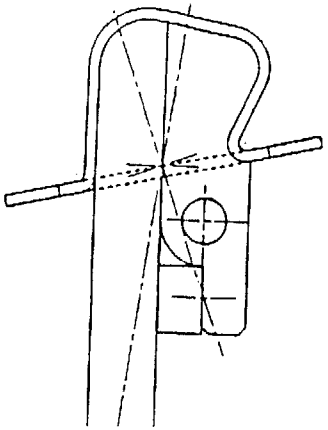
FIG. 4 shows schematically flattening of the bottom of the pot-shaped workpiece in a step of the method according to the present invention.
Figure 4:
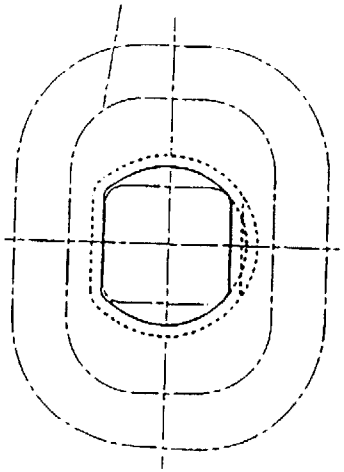

In a third step of the method according to the present invention, which is shown in FIG. 3, a second side flat surface wall is formed opposite the already formed first side wall on the pot-shaped piece. At that, in a following step of the method according to the present invention, which is shown in FIG. 3*a* and which, preferably, is effected simultaneously with the third step, the two oppositely located flat surface side walls are brought into divergent, relative to each other, angular positions, with flattening of the pot-shaped piece bottom which is effected synchronously with the bringing the two opposite side walls into their divergent angular positions (see FIG. 4).

Finally, in a fifth step of the method according to the present invention, the remaining portions of the circular circumference of the pot-shaped piece are deformed into parallel side wall to form a substantially rectangular pot-shaped piece.

Thereafter, opening defining the gudgeon are formed in the parallel side walls.

Figure 6A:
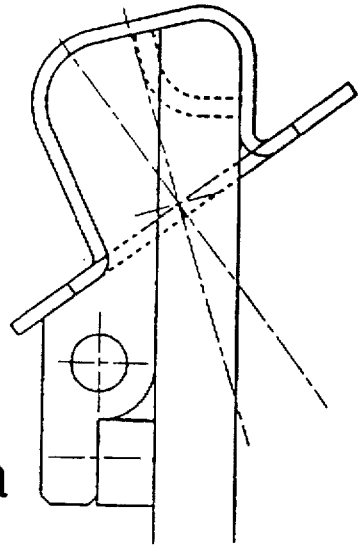
FIG. 6 shows schematically a supplementary optional step according to the inventive method of the formation of an embossed shape of parallel side walls of the pot-shaped workpiece obtained according to the present invention.
Figure 6:
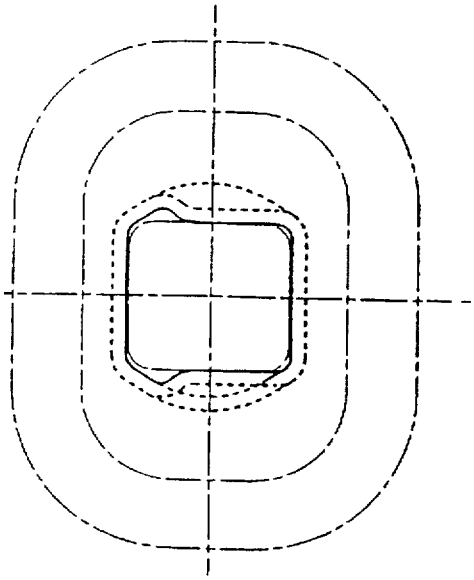

If necessary, the side walls can be provided with an embossed shape, as shown in FIG. 6.

Figure 5A:
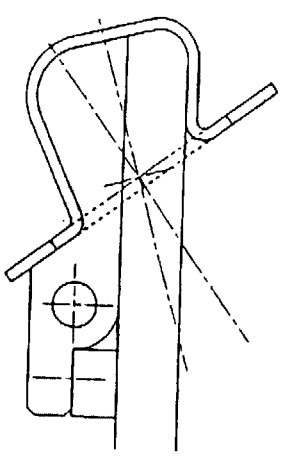
FIG. 5 shows schematically the stepwise positioning of the axis of the pot-shaped workpiece at a predetermined angle toward the plane of the rim flange.
Figure 5:
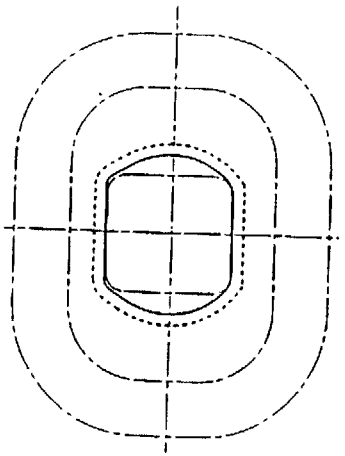

The formation of the pot-shaped workpiece essentially ends after effecting the steps shown in FIGS. 3 and 3a. However, if desired, positioning of the pot axis at an angle toward the rim flange plane can be affected in a manner shown in FIG. 5.

Though the present invention was shown and described with reference to the preferred embodiments, various modification thereof will be apparent to those skilled in the art and, therefore, it is not intended that the invention be limited to the disclosed embodiments or details thereof, and departure can be made therefrom within the spirit and scope of the appended claims.

What is claimed is:

1. A method of manufacturing of an undercut deep-drawn workpiece from a sheet material, which is closed from five sides, has at least two non-parallel walls, and has, in a plan view, a substantially rectangular shape, said method comprising the steps of:

deforming a sheet material in at least one state into a pot-shaped piece having a circular cross-section with a diameter, which decreases in a course of deformation, while retaining a flat circumferential rim flange;

increasing a depth of the pot-shaped piece with formation of an outwardly cambered bottom substantially simultaneously with decreasing the diameter of the pot-shaped piece, while retaining a circular cross-section of the pot-shaped piece;

thereafter, forming, one after another, two opposite flat surface side walls on the pot-shaped piece;

bringing the two opposite side walls into divergent, relative to each other, angular positions, with synchronously flattening the bottom of the pot-shaped piece; and thereafter, forming two further opposite flat surface side walls to obtain a substantially rectangular cross-section of the pot-shaped piece, and wherein the step of forming, one after another, two opposite side walls and the step of bringing the two opposite side walls in divergent, relative to each other, angular position are effected simultaneously.

2. A method as set forth in claim 1, wherein said step of forming two opposite side walls comprises forming relatively large arcuate transition regions between the bottom the pot-shaped piece and two opposite side wall, and wherein said step of bringing the two side walls into divergent angular positions comprises reducing a radius of at least one of the arcuate transition regions.

3. A method as set forth in claim 1, further comprising the step of deforming of at least one of the two opposite side walls in a direction transverse to the pot-shaped piece axis.

4. A method of manufacturing of an undercut deep-drawn workpiece from a sheet material, which is closed from five sides, has at least two non-parallel walls, and has, in a plan view, a substantially rectangular shape, said method comprising the steps of:

deforming a sheet material in at least one stage into a pot-shaped piece having a circular cross-section with a diameter, which decreases in a course of deformation, while retaining a flat circumferential rim flange;

increasing a depth of the pot-shaped piece with formation of an outwardly cambered bottom substantially simultaneously with decreasing the diameter of the pot-shaped piece, while retaining a circular cross-section of the pot-shaped piece;

thereafter, forming, one after another, two opposite flat surface side walls on the pot-shaped piece;

bringing the two opposite side walls into divergent, relative to each other, angular positions, with synchronously flattening the bottom of the pot-shaped piece;

thereafter, forming two further opposite flat surface side walls to obtain a substantially rectangular cross-section of the pot-shaped piece; and thereafter, forming openings in the further opposite side walls which define gudgeons.

* * * * *